US008807927B2

(12) United States Patent
Babu et al.

(10) Patent No.: US 8,807,927 B2
(45) Date of Patent: Aug. 19, 2014

(54) CLEARANCE FLOW CONTROL ASSEMBLY HAVING RAIL MEMBER

(75) Inventors: Ramesh Kempanna Babu, Karnataka (IN); Rohit Chouhan, Karnataka (IN); Santhosh Kumar Vijayan, Karnataka (IN)

(73) Assignee: General Electric Company, Schenectady, NY (US)

( * ) Notice: Subject to any disclaimer, the term of this patent is extended or adjusted under 35 U.S.C. 154(b) by 449 days.

(21) Appl. No.: 13/248,139

(22) Filed: Sep. 29, 2011

(65) Prior Publication Data

US 2013/0084168 A1 Apr. 4, 2013

(51) Int. Cl.
*F01D 5/20* (2006.01)
*F01D 11/12* (2006.01)
*F01D 5/22* (2006.01)

(52) U.S. Cl.
CPC ..... *F01D 5/225* (2013.01); *F01D 11/122* (2013.01)
USPC ..... 415/173.5

(58) Field of Classification Search
CPC ..... F01D 11/003; F01D 11/025
USPC ..... 415/173.1, 173.4, 173.5; 277/411, 412, 277/415, 418–420
See application file for complete search history.

(56) References Cited

U.S. PATENT DOCUMENTS 3,897,169 A * 7/1975 Fowler ..... 415/173.6
6,164,655 A * 12/2000 Bothien et al. ..... 277/303
7,255,531 B2 8/2007 Ingistov
7,445,213 B1 * 11/2008 Pelfrey ..... 277/418
8,167,547 B2 * 5/2012 Wu et al. ..... 415/173.5
2010/0276892 A1 * 11/2010 Sanchez et al. ..... 277/419
2011/0070074 A1 3/2011 Schabowski et al.
2011/0085892 A1 * 4/2011 John et al. ..... 415/171.1
2011/0293402 A1 * 12/2011 Kreiselmaier et al. ..... 415/116
2012/0070309 A1 * 3/2012 Zambetti et al. ..... 416/97 R

FOREIGN PATENT DOCUMENTS

EP 1793086 A2 6/2007
GB 767656 A * 2/1957
JP 2002-228014 A * 8/2002

OTHER PUBLICATIONS

Hirano, Labyrinth seal, Aug. 14, 2002, Abstract of JP 2002-228014A.*
Search Report and Written Opinion from EP Application No. 12185988.8 dated Jan. 24, 2013.

* cited by examiner

*Primary Examiner* — Liam McDowell
(74) *Attorney, Agent, or Firm* — Cantor Colburn LLP

(57) ABSTRACT

A flow control assembly is provided, including a member and a wall. The member has a surface, a flow diverting member and a rail member. The rail member is situated upstream of the flow diverting member. The flow diverting member and the rail member each project from the surface of the member. The flow diverting member has a distal end. The wall is disposed in relation to the member to create a clearance gap between the distal end of the flow diverting member and the wall. A fluid path is created between the member and the wall, and flows from an upstream section and through the clearance gap. A first chamber and a second chamber are defined by the wall and located upstream of the clearance gap.

14 Claims, 6 Drawing Sheets

CLEARANCE FLOW CONTROL ASSEMBLY HAVING RAIL MEMBER

BACKGROUND OF THE INVENTION

The subject matter disclosed herein relates to a flow control assembly, and more specifically to a flow control assembly having a wall with first and second chambers, where the second chamber directs a fluid path into a vortex configuration.

Generally, a turbine stage of a gas engine turbine includes a row of stationary vanes followed by a row of rotating blades in an annular turbine casing. The flow of fluid through the turbine casing is partially expanded in the stationary vanes and directed toward the rotating blades, and is further expanded to generate power. There is a physical clearance requirement between the tip of the rotating blade and an interior surface of the turbine casing to generally avoid interference between the blade and the turbine casing. Typically, turbine buckets are provided with a cover for improved aerodynamic and mechanical performance. A rail protruding out of the cover is used to reduce the physical clearance between the turbine casing and the rotating blade. The clearance requirement varies based on the dynamic and thermal behaviors of the rotor and the turbine casing.

If the clearance requirement between the turbine casing and the rotating blade is relatively high, then a relatively high amount of high energy fluid flow is able to escape between the tip of the blade and the interior surface of the turbine casing without generating any useful power during turbine operations. The escaping high energy fluid flow constitutes tip clearance loss and can be one of the major sources of losses in the turbine stages. For example, in some cases, the tip clearance losses constitute 20-25% of the total losses in a turbine stage.

Any reduction in the amount of tip clearance flow can result in a direct gain in power and performance of the turbine stage. Typically, such reductions can be achieved by reducing the physical clearance between the rotor tip and the turbine casing. This reduction, however, also increases the chance rubbing or interference between the rotating and stationary components. Another approach to reduce the tip clearance flow involves reducing the effective clearance between the rotor tip and casing by employing a duel vortex chamber in the turbine casing. However, this approach may be difficult to implement due to aerodynamic issues in the turbine.

BRIEF DESCRIPTION OF THE INVENTION

According to one aspect of the invention, a flow control assembly is provided, including a member and a wall. The member has a surface, a flow diverting member and a rail member. The rail member is situated upstream of the flow diverting member. The flow diverting member and the rail member each project from the surface of the member. The flow diverting member has a distal end. The wall is disposed in relation to the member to create a clearance gap between the distal end of the flow diverting member and the wall. A fluid path is created between the member and the wall, and flows from an upstream section and through the clearance gap. A first chamber and a second chamber are defined by the wall and located upstream of the clearance gap. The rail member diverts the fluid path in the first chamber into a generally curved configuration and the second chamber directs the fluid path into a vortex configuration.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
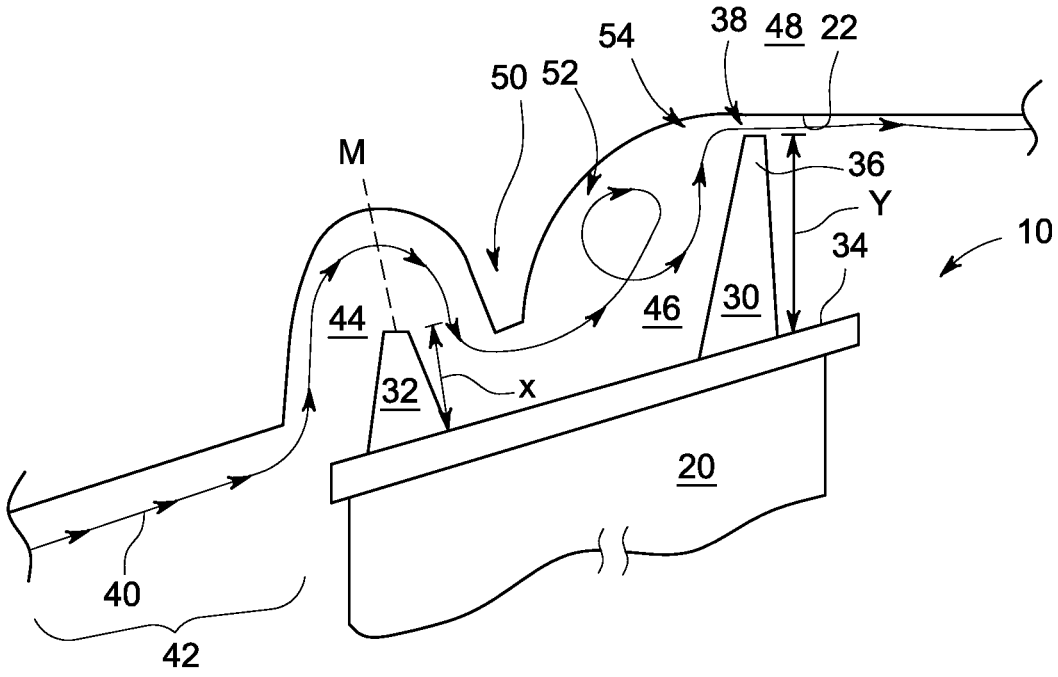
FIG. 1 is a side sectional view of a flow control assembly.
Figure 2:
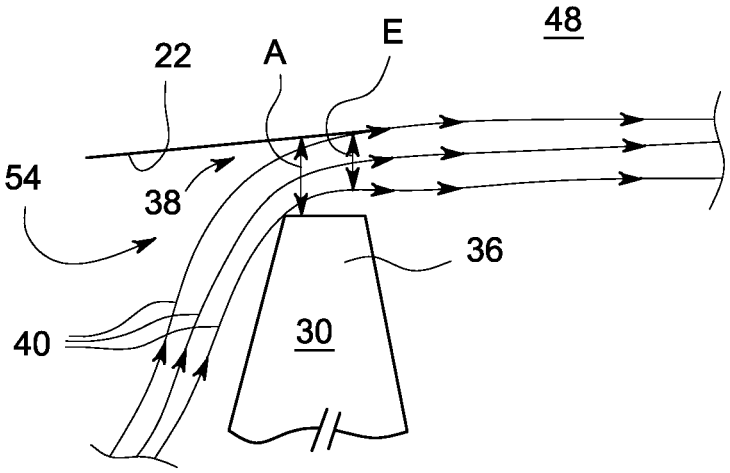
FIG. 2 is an enlarged view of a flow diverting member shown in FIG. 1.

FIG. 1 is an illustration of an exemplary flow control assembly 10. The flow control assembly 10 includes a member 20 and a wall 22. The member 20 includes a flow diverting member 30 and a rail member 32. Both the flow diverting member 30 and the rail member 32 project outwardly from an outer surface 34 of the member 20, and towards the wall 22. Referring now to both FIGS. 1-2, the wall 22 is disposed in relation to a distal end 36 of the member 20 to create a clearance gap 38. Specifically, FIG. 2 illustrates that the clearance gap 38 includes an actual clearance gap A as well as an effective clearance gap E. A fluid path 40 is provided between the member 20 and the wall 22, where the fluid path 40 flows from an upstream section 42 and through the clearance gap 38. In one exemplary embodiment, the flow control assembly 10 may be employed in a gas turbine engine. For example, in one embodiment the member 20 may be a rotatable turbine blade and the wall 22 is part of a turbine casing 48 that perimetrically surrounds the turbine blade.

The wall 22 includes a first chamber 44 and a second chamber 46. Both the first chamber 44 and the second chamber 46 are located upstream of the clearance gap 38, and the first chamber 44 is located upstream of the second chamber 46. The first chamber 44 includes a generally curved or concave configuration. A protrusion 50 is located between the first and second chamber 44 and 46. In the embodiment as illustrated in FIG. 1, the protrusion 50 is situated downstream of the rail member 32 and upstream of the flow diverting member 30. FIG. 1 also illustrates the second chamber 46 transitioning from the protrusion 50 in a generally filleted configuration 52.

The fluid path 40 is directed to flow into the first and second chambers 44, 46 in a singular vortex configuration prior to flowing through the clearance gap 38. Specifically, the rail member 32 is situated along the outer surface 34 of the member 20 to divert the fluid path 40 in the first chamber 44 into a generally curved configuration. The fluid path 40 then flows around a protrusion 50 that is located between the first chamber 44 and the second chamber 46. The fluid path 40 then flows into the second chamber 46, where the fluid flow 40 is directed into a vortex configuration prior to flowing through the clearance gap 38. Because the fluid path 40 flows in the generally curved configuration and the vortex configuration, the effective flow area E of the fluid path 40 through the actual clearance gap A is reduced such that E<A. That is, the rail member 32 diverts the fluid path 40 in a curved configuration towards the wall 22 of the first chamber 44. The second chamber 46 then allows for the fluid path 40 to flow in a vortex configuration, which causes the fluid path 40 to take a relatively sharp turn 54. In one embodiment, the sharp turn 54 may be about ninety degrees. The fluid path 40 takes the sharp turn 54 and flows over the flow diverting member 30 such that the fluid path 40 is generally unable to flow through the entire thickness of the actual clearance gap A, which is shown in FIG. 2. In a simulation, a typical turbine stage with first and second chambers 44 and 46 has shown an effective reduction in clearance flow for constant physical clearance gaps with corresponding improvement in stage efficiency.

In the exemplary embodiment as shown in FIG. 1, the rail member 32 includes a height X and the flow diverting member 30 includes a height of Y, where the rail member 32 is about half the height of the flow diverting member 30. However, it is to be understood that other configurations of the flow diverting member 30 and the rail member may be used as well. For example, the rail member 32 may increase in height such that the height X of the rail member 32 is about equal to the height Y of the flow diverting member 30.

Figure 3:
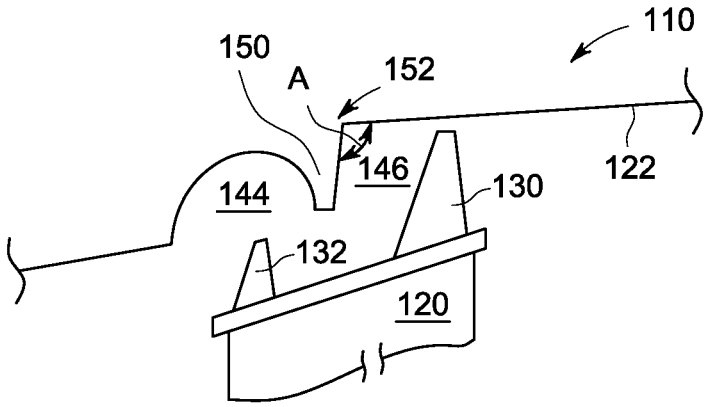
FIG. 3 is a side sectional view of an alternative embodiment of the flow control assembly shown in FIG. 1.

Although FIG. 1 illustrates the second chamber 46 transitioning from the protrusion 50 in a generally filleted configuration 52, it is understood that other configurations may be used as well. Specifically, FIG. 3 is an alternative embodiment of a flow control assembly 110. The flow control assembly 110 includes a member 120 and a wall 122, where the member 120 includes a flow diverting member 130 and a rail member 132. The wall 122 includes a first chamber 144 and a second chamber 146, and a protrusion 150 situated downstream of the rail member 132 and upstream of the flow diverting member 130. In the embodiment as shown in FIG. 3, the second chamber 146 transitions from the protrusion 150 in a generally angled configuration 152. Specifically, in the exemplary embodiment as shown, a substantially right angle A is situated between the protrusion 150 and the second chamber 146.

Figure 4:
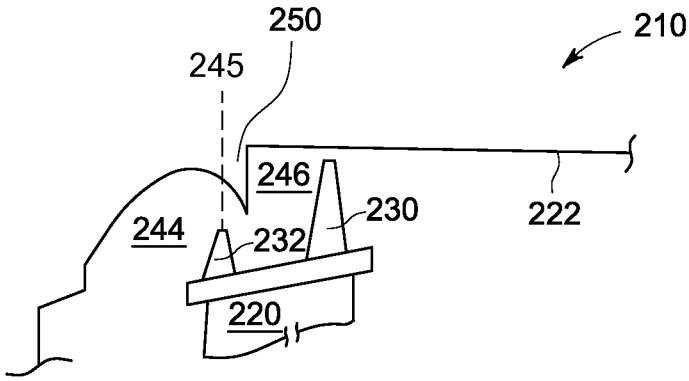
FIG. 4 is a side sectional view of another alternative embodiment of the flow control assembly shown in FIG. 1.
Figure 5:
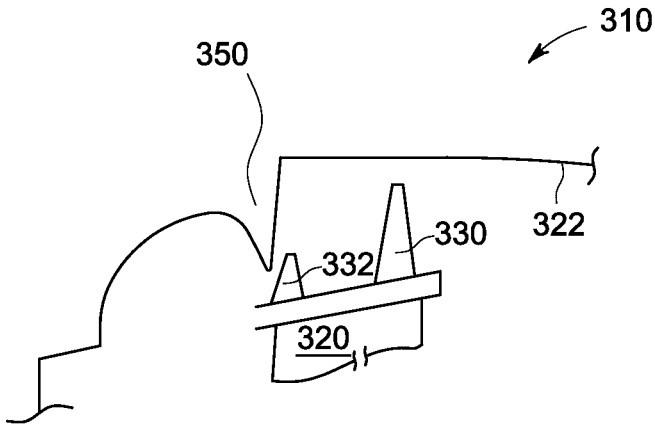
FIG. 5 is a side sectional view of yet another alternative embodiment of the flow control assembly shown in FIG. 1.

Turning back to FIG. 1, in the embodiment as shown the rail member 32 is generally aligned with a midpoint M of the first chamber 44. However, it is understood that the rail member 32 may be positioned relative to the rail member 32 in other configurations as well. For example, turning to FIG. 4, a flow control assembly 210 is illustrated and includes a member 220 and a wall 222, where the member 220 includes a flow diverting member 230 and a rail member 232. The wall 222 includes a first chamber 244 and a second chamber 246, and a protrusion 250 situated downstream of the rail member 232. Specifically, in the embodiment as shown in FIG. 4, the rail member 232 is positioned to be generally aligned with an end portion 245 of the first chamber 244. It should be noted that the protrusion 250 may be positioned upstream of the rail member 232 as well. For example, FIG. 5 illustrates a flow control assembly 310 having a protrusion 350 that is positioned upstream of the rail member 332.

Figure 6:
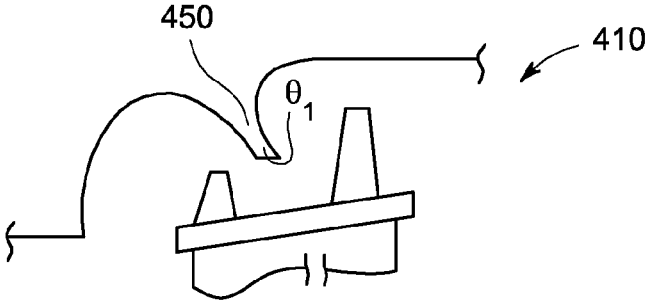
FIG. 6 is a side sectional view of an alternative embodiment of the flow control assembly shown in FIG. 1.
Figure 7:
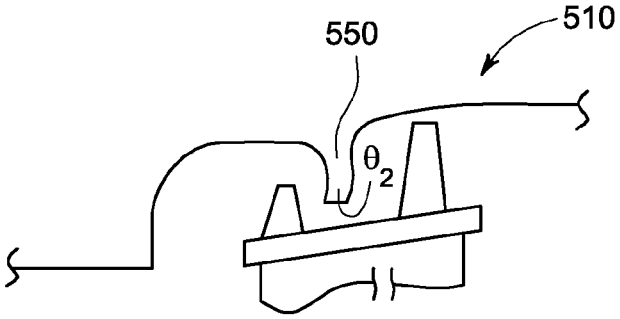
FIG. 7 is a side sectional view of another alternative embodiment of the flow control assembly shown in FIG. 1.
Figure 8:
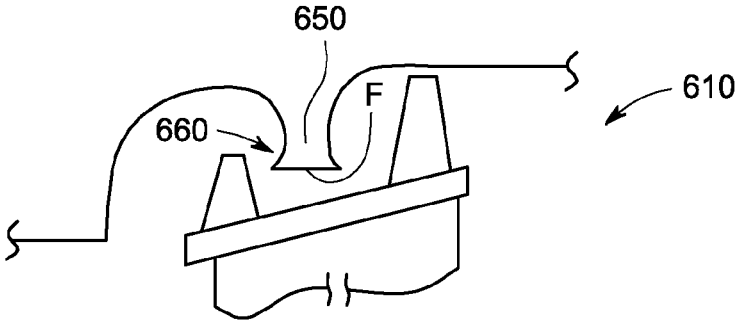
FIG. 8 is a side sectional view of yet another alternative embodiment of the flow control assembly shown in FIG. 1.

In yet another embodiment as shown in FIGS. 6-7, the protrusions 450 and 550 may be angled in a downstream direction $\theta_1$, which is illustrated in FIG. 6, or in an upstream direction $\theta_2$. In another embodiment as shown in FIG. 8, a protrusion 650 may includes a flare F at a distal end 660 of the protrusion 650. The flare F may point in either or both of the upstream and downstream directions. While the embodiments of FIGS. 3-8 are illustrated separately, it is understood that the various embodiments may be provided in various combinations with one another and that other configurations in line with those described above are possible.

Figure 9:
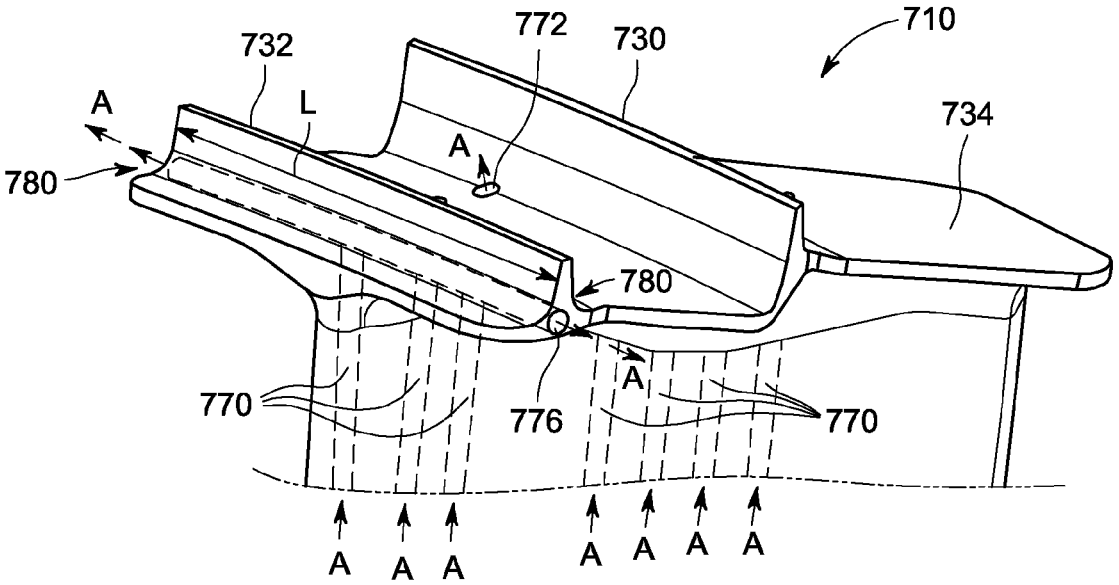
FIG. 9 is an elevational view of another embodiment of the a turbine blade shown in FIG. 1.

FIG. 9 is an elevated perspective view of a portion of a turbine blade 720 having a flow diverting member 730 and a rail member 732. The turbine blade 720 includes a set of cooling passages 770 that extend longitudinally along the turbine blade 720. A cooling air A travels through the passages 770 and escape through a plurality of cooling holes 772 that are located on a surface 734 of the turbine blade 720. At least one of the cooling passages 770 are fluidly connected to a cooling hole 776 located in the rail member 732. Specifically, in the embodiment as shown, the cooling hole 776 extends along a length L of the rail member 732, where the cooling air A may exit both ends 780 of the rail member 732.

Figure 10:
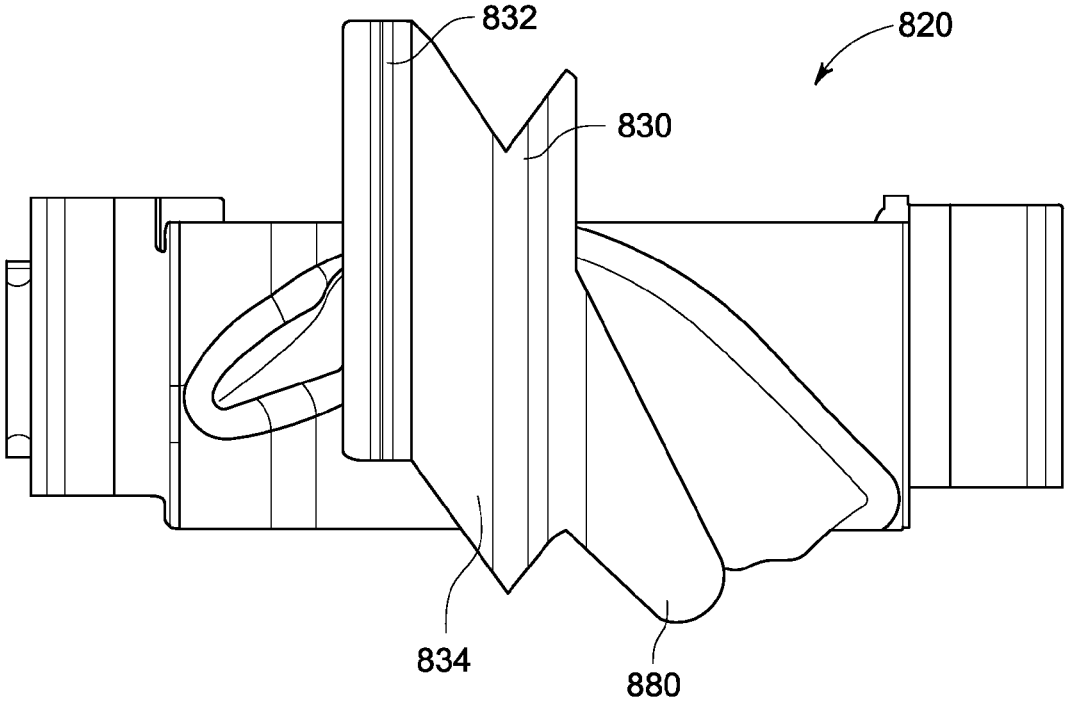
FIG. 10 is a top view of the turbine blade shown in FIG. 1.

FIG. 10 is a top view of a turbine blade 820 having a flow diverting member 830 and a rail member 832. The turbine blade 820 also includes a top surface 834 where the flow diverting member 830 and the rail member 832 are located thereon. The turbine blade 820 also includes a tip portion 880. The tip portion 880 of the turbine blade represents an outer area or portion of the turbine blade 820. The rail member 832 provides support to the turbine blade 820 such that stress in the tip portion 880 is reduced when compared to a turbine blade that does not include a rail stiffener.

Figure 11:
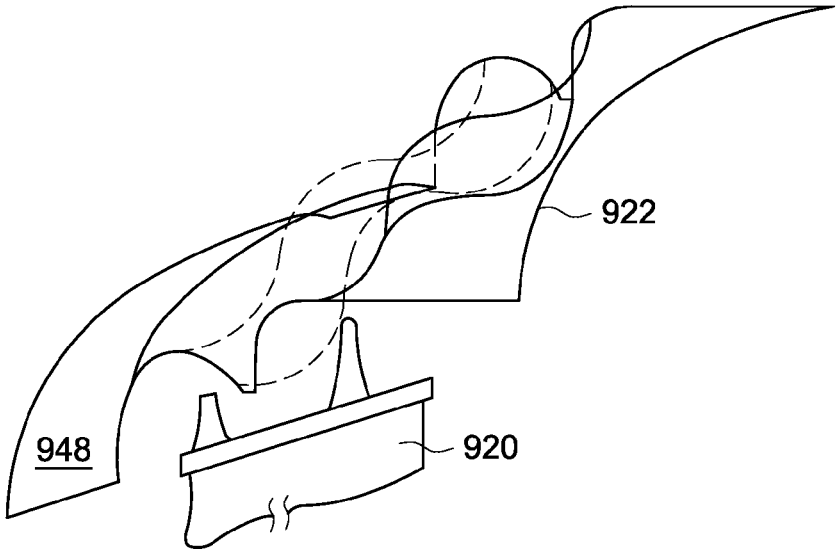
FIG. 11 is a side sectional view of an alternative embodiment of the flow control assembly shown in FIG. 1.
Figure 12:
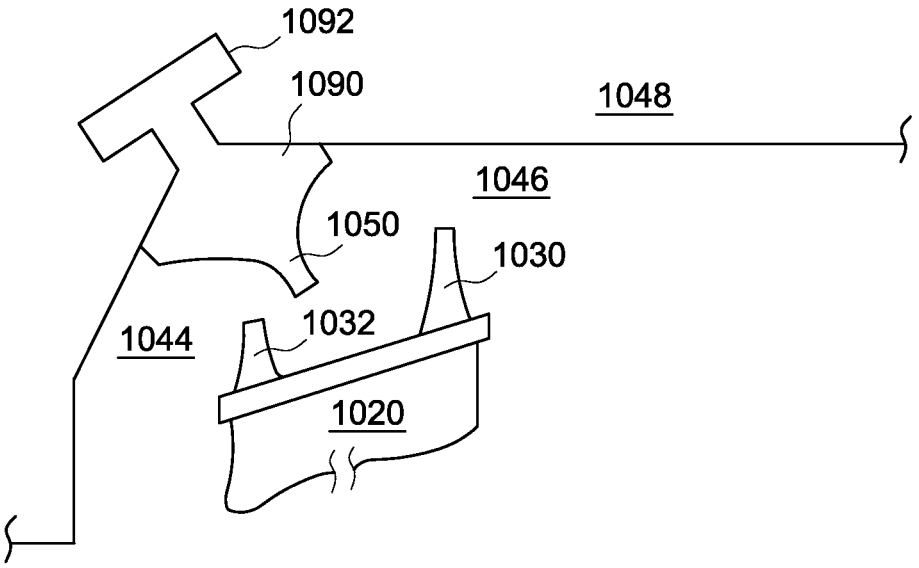
FIG. 12 is a side sectional view of another alternative embodiment of the flow control assembly shown in FIG. 1.

In one exemplary embodiment as shown in FIG. 11 illustrating a turbine blade 920 and a wall 922, the wall 922 is part of a non-axis-symmetric casing 948. In yet another embodiment as shown in FIG. 12, a first chamber 1044 and a second chamber 1046 are located in a turbine casing 1048. A protrusion 1050 located between the first and second chambers 1044 and 1046 is created out of a single component, or by using multiple components assembled together. Specifically, in the embodiment as shown in FIG. 12, the protrusion 1050 is a separate removable piece 1090 assembled in a casing T-slot 1092. This configuration may be useful during upgrades of engine to incorporate chambers. The first chamber 1044 and the second chamber 1046 may be applied to new gas or steam turbines as well as turbines that are already operational. For operational turbines, the first chamber 1044 and the second chamber 1046 may be offered as part of a service package during upgrades.

Figure 13:
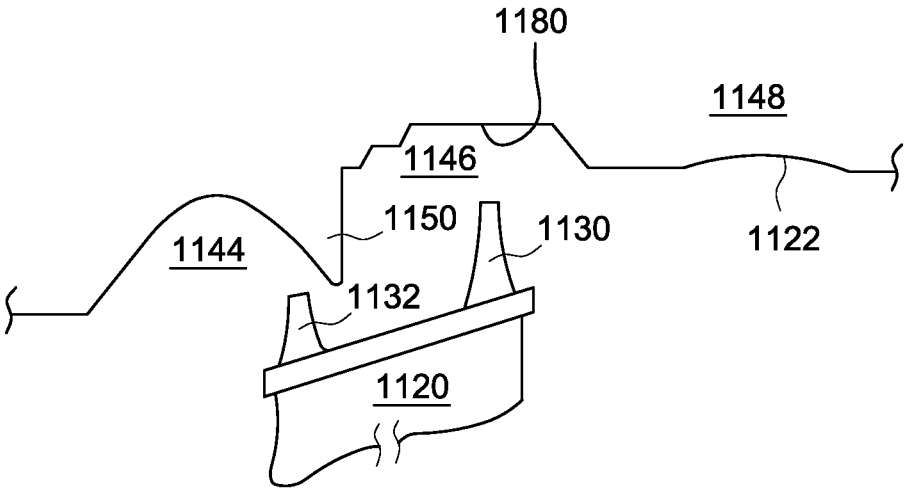
FIG. 13 is a side sectional view of yet another alternative embodiment of the flow control assembly shown in FIG. 1.

In yet another embodiment as shown in FIG. 13, a casing 1148 and a flow diverting member 1130 of a turbine blade 1120 are provided. The flow diverting member 1130 is positioned such that the flow diverting member 1130 may be selectively deployed and makes contact against an abradable or a honeycomb surface 1122 of the casing 1148. The contact between the flow diverting member 1130 and the surface 1122 creates a groove shape 1180 in the casing 1148 in a second chamber 1146. Specifically, during operation of a turbine, the turbine blade 1120 rotates such that the flow diverting member 1130 may contact the surface 1122, thereby creating the groove 1180. The groove 1180 may further define a second chamber 1146 that is located in the casing 1148.

Figure 14:
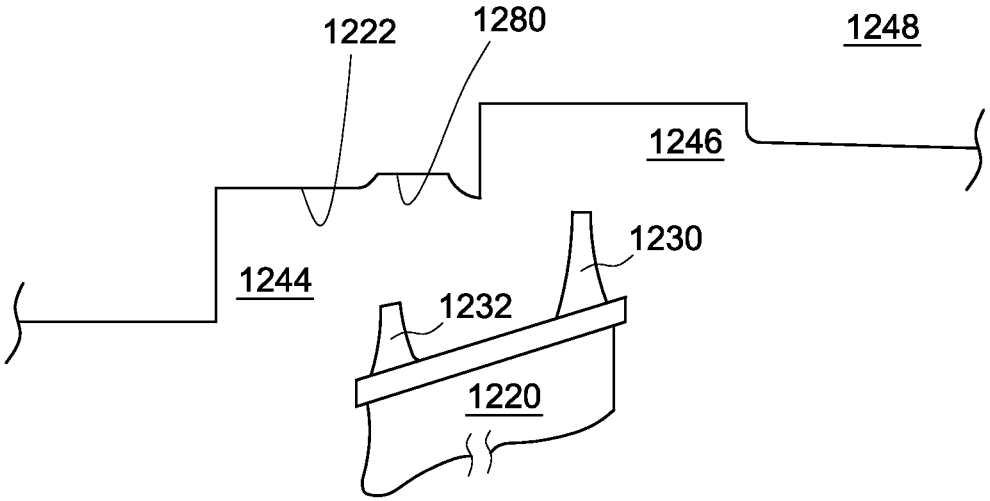
FIG. 14 is a side sectional view of an alternative embodiment of the flow control assembly shown in FIG. 1.
Figure 15:
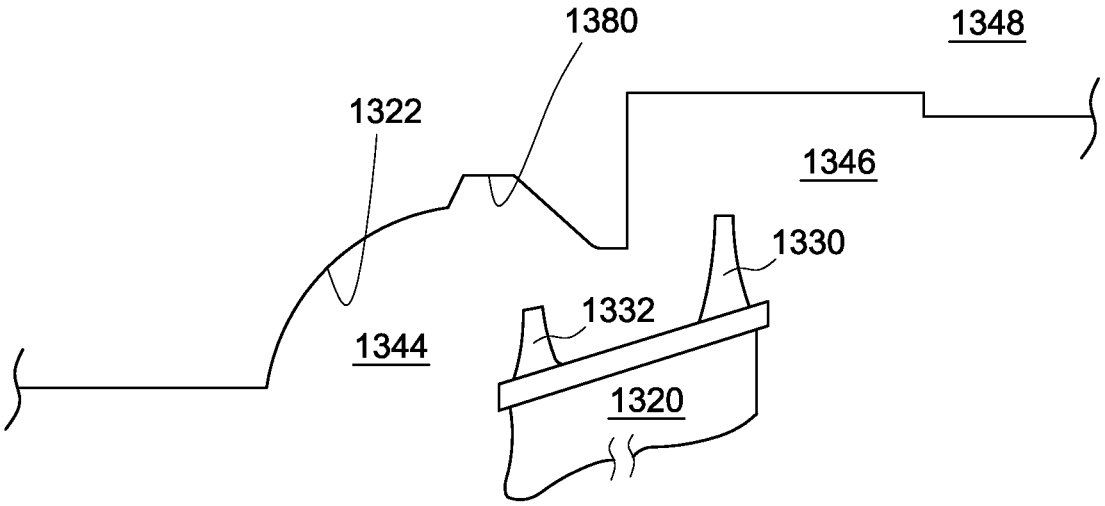
FIG. 15 is a side sectional view of another alternative embodiment of the flow control assembly shown in FIG. 1.

In still yet another embodiment as shown in FIG. 14, a casing 1248, a flow diverting member 1230, and a rail member 1232 of a turbine blade 1220 are provided. The rail member 1232 is positioned such that the rail member 1232 may be selectively deployed and makes contact against an abradable or a honeycomb surface 1222 of the casing 1248. The contact between the rail member 1232 and the surface 1222 creates a groove shape 1280 in the casing 1248 in a first chamber 1244 during operation. FIG. 15 is an illustration of yet another embodiment including a casing 1348, a flow diverting member 1330, and a rail member 1332 of a turbine blade 1320. The rail member 1332 is positioned such that the rail member 1332 may be selectively deployed and makes contact against an abradable or a honeycomb surface 1322 of the casing 1348. In the embodiment as shown in FIG. 15, the surface 1322 and a first chamber 1344 includes a generally curved or concave configuration. The contact between the rail member 1332 and the surface 1322 creates a groove shape 1380 in the casing 1348 during operation.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A flow control assembly, comprising:

a member having a surface, the member comprising a turbine blade;

a flow diverting member and a rail member, the rail member situated upstream of the flow diverting member, the flow diverting member and the rail member each projecting from the surface of the member, the flow diverting member having a distal end, wherein the rail member includes a rail member radial length that is from half of a flow diverting member length to a full flow diverting member length;

a wall disposed in relation to the member to create a clearance gap between the distal end of the flow diverting member and the wall, a fluid path created between the member and the wall and flowing from an upstream section and through the clearance gap, the wall comprising a turbine casing perimetrically surrounding the member;

a first chamber and a second chamber defined by the wall and located upstream of the clearance gap, the rail member diverting the fluid path in the first chamber into a generally curved configuration and the second chamber directing the fluid path into a vortex configuration wherein the first chamber is disposed upstream of the second chamber; and a single protrusion tooth extending radially from the wall and axially located upstream of the rail member.

2. The flow control assembly of claim 1, wherein the clearance gap includes an actual clearance gap area and an effective flow area, wherein the actual clearance gap area is the distance between the wall and the distal end of the flow diverting member, and the effective flow area of the fluid path through the actual clearance gap is reduced such that the effective flow area is less than the actual clearance gap.

3. The flow control assembly of claim 1, wherein the first chamber transitions from the protrusion in a generally filleted configuration.

4. The flow control assembly of claim 1, wherein the first chamber transitions from the protrusion in a generally angled configuration, wherein a substantially right angle is located between the first chamber and the protrusion.

5. The flow control assembly of claim 1, wherein the protrusion is angled in one of a downstream direction and an upstream direction.

6. The flow control assembly of claim 1, wherein a distal end of the protrusion includes a flared configuration.

7. The flow control assembly of claim 1, wherein the rail member includes at least one cooling hole that is oriented in a lengthwise direction.

8. The flow control assembly of claim 1, wherein the turbine casing includes a non-symmetric casing.

9. A turbine having a flow control assembly, comprising:

a turbine blade having a surface;

a flow diverting member and a rail member, the rail member situated upstream of the flow diverting member, the flow diverting member and the rail member each projecting from the surface of the turbine blade, the flow diverting member having a distal end, wherein the rail member includes a rail member radial length that is from half of a flow diverting member length to a full flow diverting member length;

a turbine casing disposed in relation to the turbine blade to create a clearance gap between the distal end of the flow diverting member and the turbine casing, a fluid path created between the turbine blade and the turbine casing and flowing from an upstream section and through the clearance gap;

a first chamber and a second chamber defined by the turbine casing and located upstream of the clearance gap, the rail member diverting the fluid path in the first chamber into a generally curved configuration and the second chamber directing the fluid path into a vortex configuration, the clearance gap including an actual clearance gap area and an effective flow area, the actual clearance gap area being the distance between the turbine casing and the distal end of the flow diverting member, and the effective flow area of the fluid path through the actual clearance gap being reduced such that the effective flow area is less than the actual clearance gap, wherein the first chamber is disposed upstream of the second chamber; and single protrusion tooth extending radially from the wall and axially located upstream of the rail member.

10. The turbine of claim 9, wherein the first chamber transitions from the protrusion in a generally filleted configuration.

11. The turbine of claim 9, wherein the first chamber transitions from the protrusion in a generally angled configuration, wherein a substantially right angle is located between the first chamber and the protrusion.

12. The turbine of claim 9, wherein the protrusion is angled in one of a downstream direction and an upstream direction.

13. The turbine of claim 9, wherein the protrusion comprises a removable member.

14. The turbine of claim 9, wherein the turbine casing includes at least one of an abradable and a honeycomb surface, and wherein the flow diverting member creates a groove along a surface of the turbine casing.

* * * * *